175-40 SR
1/24/84 XR 4,427,080

United States Patent [19]
Steiger

[11] 4,427,080
[45] Jan. 24, 1984

[54] APPARATUS FOR PREVENTING DIFFERENTIAL STICKING IN WELLS

[75] Inventor: Ronald P. Steiger, Houston, Tex.

[73] Assignee: Exxon Production Research Co., Houston, Tex.

[21] Appl. No.: 215,209

[22] Filed: Dec. 11, 1980

[51] Int. Cl.[3] ..... E21B 17/16; E21B 47/00
[52] U.S. Cl. ..... 175/325; 138/143; 138/146; 175/40; 464/183
[58] Field of Search ..... 175/325, 320, 45, 50, 175/40; 166/228, 241, 242, 64; 138/141-143, 145, 146; 308/4 A; 324/367, 369, 346, 351; 250/254; 73/155; 64/1 R; 464/183

[56] References Cited

U.S. PATENT DOCUMENTS

| | | | |
|---|---|---|---|
| 1,710,471 | 4/1929 | Cater | 166/228 X |
| 2,335,558 | 11/1943 | Young | 166/228 |
| 2,392,263 | 1/1946 | Records | 166/228 X |
| 2,569,625 | 10/1951 | Wyllie | 324/351 |
| 2,843,209 | 7/1958 | Degen | 166/228 |
| 2,981,333 | 4/1961 | Miller et al. | 166/228 X |
| 3,173,488 | 3/1965 | Rensvold | 166/228 |
| 3,361,203 | 1/1968 | Rensvold | 166/228 X |
| 3,411,321 | 11/1968 | Schurman | 464/183 |

FOREIGN PATENT DOCUMENTS

| | | | |
|---|---|---|---|
| 502655 | 5/1951 | Belgium | 166/228 |

*Primary Examiner*—Stephen J. Novosad
*Attorney, Agent, or Firm*—E. Thomas Wheelock

[57] ABSTRACT

A porous layer is placed on the outside of various well implements. The layer allows movement of liquid toward sites of localized low pressure and therefore prevents differential pressure stickage of the well implements on the borehole wall.

33 Claims, 5 Drawing Figures

APPARATUS FOR PREVENTING DIFFERENTIAL STICKING IN WELLS

BACKGROUND OF THE INVENTION

This invention relates to preventing downhole equipment from sticking in well boreholes. The invention contemplates the use of improved drill collars and other well implements having a porous coating placed on at least a portion of those implements.

In the drilling of oil wells, gas wells, lixiviant injection wells, and other boreholes, various strata are bypassed in achieving the desired depth. Each of these subsurface strata has associated with it physical parameters, e.g., porosity, liquid content, hardness, pressure, etc., which make the drilling art an ongoing challenge. Drilling through a stratum produces an amount of rubble and frictional heat; each of which must be removed if efficient drilling is to be maintained. In rotary drilling operations, heat and rock chips are removed by the use of a liquid known as drilling fluid or mud. Most rotary drilling apparatus use a hollow drill string made up of a number of drill pipe sections and, of course, a drill bit at the bottom. Drilling fluid is circulated down through the drill string, out through orifices in the drill bit where it picks up rock chips and heat and returns up the annular space between the drill string and the borehole wall to the surface. There it is sieved, reconstituted and directed back down into the drill string.

Drilling fluid may be as simple in composition as clear water or it may be a complicated mixture of clays, thickeners, dissolved inorganic components, and weighting agents. The charactertistics of the drilled geologic strata and, to some extent, the drilling apparatus determine the physical parameters of the drilling fluid. For instance, while drilling through a high pressure layer, e.g., a gas formation, the density of the drilling fluid must be increased to the point that the hydraulic or hydrostatic head of the fluid is greater than the downhole pressure of the stratum to prevent gas leakage into the annular space surrounding the drill pipe and lower chances for a blowout.

In strata which are porous in nature and additionally have a low formation pressure, another problem occurs. Some of the drilling fluid, because of its hydrostatic head, migrates out into the porous layer rather than completing its circuit to the surface. One common solution of this problem is to use a drilling fluid which contains bentonite clay or other filtration control additives. The porous formation tends to filter the filtration control additive from the drilling fluid and forms a filter cake on the borehole wall thereby preventing the outflow of drilling fluid. As long as this filter cake is intact, very little fluid is lost to the formation.

During drilling, the rotating drillstring is closely adjacent or in contact with the filter cake. If the filter cake is soft, thick, or of poor quality or if the drill string thins the filter cake, then the higher hydrostatic head of the drilling fluid will tend to push the drill string into the filter cake. In some cases the drill string will stick to the borehole wall. This phenomenon is known as differential pressure or hydrostatic sticking. In severe cases, it will be impossible to either turn the drill string or even move it up and down the borehole. It is this problem for which the apparatus of the invention is a solution.

The two widely used methods of alleviating hydrostatic or differential pressure sticking attack the problem from different flanks; one is remedial and the other preventative.

Once a drill string is stuck against a filter cake adjacent a porous formation, the remedy of a chemical spotting agent is used. It is first necessary to determine where on the drill string the stickage has occurred. One such method involves stretching the drill string by pulling it at the surface. Charts are available correlating the resulting stretch (per amount of applied stress) with feet of drill pipe. Once this information is known, the injection of water-based drilling fluid is interrupted and the spotting agent substituted. The spotting agents are often oleophilic compositions and may be oil-based drilling fluids, invert emulsions of water in oil, or a material as readily available as diesel oil. After the slug of, typically, 10–50 barrels of spotting agent is introduced, addition of drilling fluid is re-commenced. The slug of spotting agent continues its trip down through the drill string, out the drill bit, and up the wellbore annulus until it reaches the site of the stickage. Upon arrival of the spotting agent at the stickage location, circulation is temporarily ceased. Those skillful in this art speculate that oil-based spotting agents tend to dehydrate the filter cake on the borehole wall and cause it to break up, thereby allowing the drill string to come free. In any event, once movement of the drill string is detected, circulation of the drilling fluid is restored. It should be observed that the cost of this process is high and the success rate only moderate.

A preventative method of allaying drill string stickage in porous formations entails the use of drill collars having flutes, spirals, or slots machined in the outer surfaces. This method is used to a lesser extent than the spotting agent method since it involves a higher capital expense, and results in lighter drill collars. Drill collars are, of course, used for the specific purpose of adding weight to the lower end of a drill string. Consequently light drill collars are not viewed with much enthusiasm. Although these collars are somewhat more effective in preventing stickage, they are not immune to the problem since the exterior grooves can be plugged, inter alia, with soft clay.

SUMMARY OF THE INVENTION

The purpose of this invention is to provide downhole well implements with reduced susceptibility to differential pressure sticking. In particular it involves providing such implements with a wear-resistant porous layer or coating. This coating may be permeated with a chemical spotting agent.

The implements typically requiring such a coating would be either drill collars or logging tools. Drill collars are essentially heavy drill pipe sections and are placed between the drill bit and the upper section of drill pipe. They are used to stabilize the drill string and weight the drill bit during drilling operations. Logging tools are instruments lowered into an open borehole on a wire-line or cable to measure various formation parameters, e.g., resistivity, sonic velocity, etc. These measurements are then transformed into usable information regarding, for instance, natural gas or oil content.

The applied porous coating is one that does not present a large unbroken surface area to the filter cake but does allow liquid migration within the coating from the open borehole area to an area of contact with the filter cake. It is theorized that the porous coating's capability of allowing liquid to flow toward the area of the drill string's contact with the thinned filter cake is the physical characteristic which prevents substantial differential pressure sticking.

It is further contemplated that the pores of the coating may be impregnated with an oleophilic composition having a viscosity between that of a light oil and a grease and having the capability of acting as a localized spotting agent.

DESCRIPTION OF THE PREFERRED EMBODIMENTS

Figure 1:
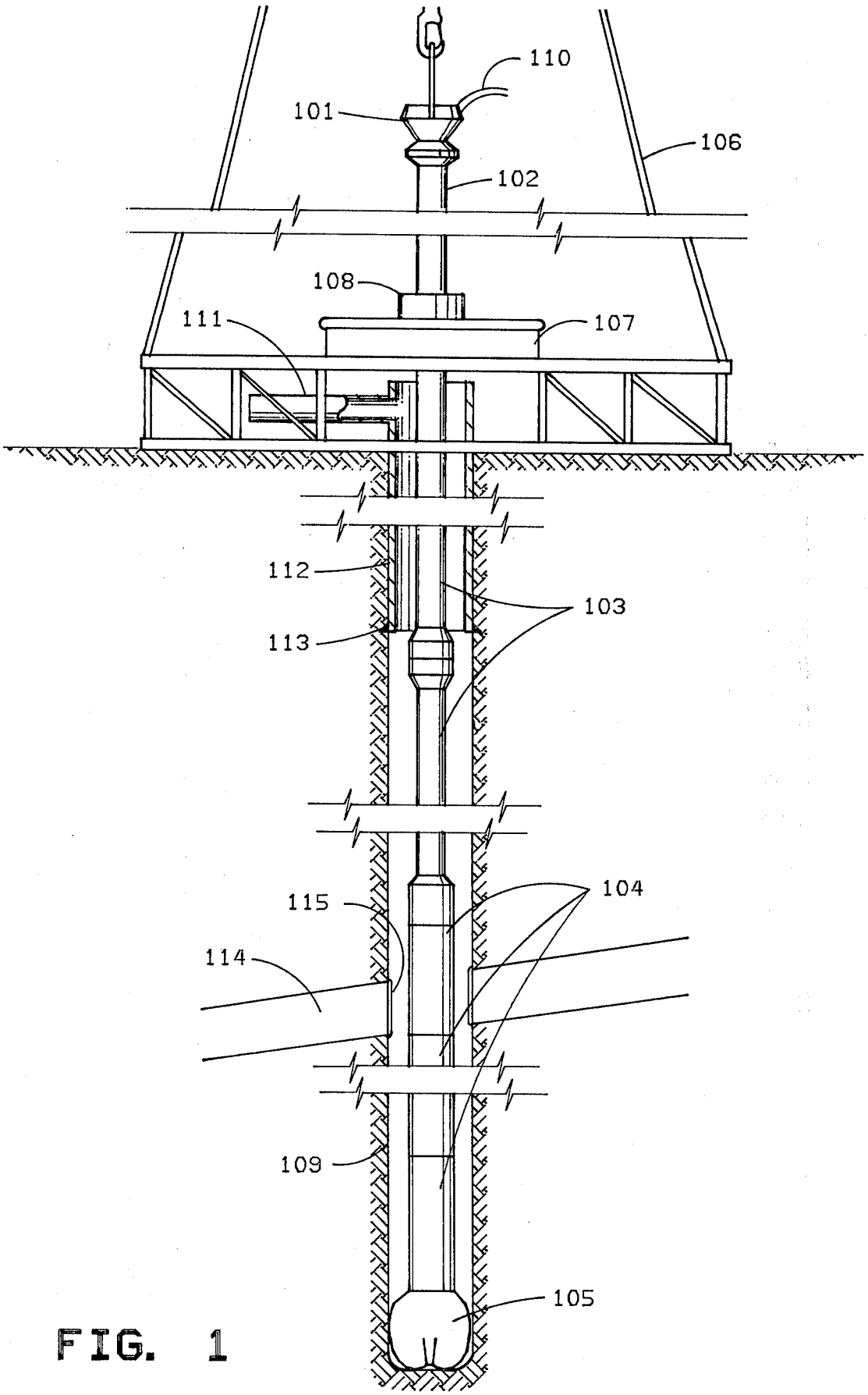
FIG. 1 is a schematicized depiction of a typical drilling rig.

A conventional rotary drilling rig is shown in FIG. 1. The portion below ground consists of a drill string and is made up of upper drill pipe sections 103, drill collars 104, and drill bit 105. Pipe sections 103 and drill collars 104 are little more than threaded hollow pipe which are rotated by equipment on the surface. Drill collars 104 are significantly heavier than are the sections of drill pipe 103 because they are intended to weight drill bit 105, steady the drill string and keep it in tension.

The drill string is turned by use of kelly 102, a flat-sided hollow pipe often square in cross section, which is screwed into the uppermost section of drill pipe 103. The kelly is turned by a powered rotary table 107 through a kelly bushing 108. The drill string and kelly 102 are supported by rig hoisting equipment on derrick 106.

While the drill string is turning, a drilling fluid or mud is pumped into the swivel 101 from a hose attached to connection 110. The drilling fluid proceeds down through kelly 102, upper drill pipes 103, and drill collars 104. The drilling fluid exits through orifices in drill bit 105 and flows upwardly through the annulus between the borehole wall 109 and either the drill collars 104 or the drill pipe sections 103. Drilling fluid leaves the well through pipe 111 for subsequent recovery, reconstitution and recycling.

For purposes of illustration, the depicted well has a porous stratum or layer 114. The well has been treated with a drilling fluid which left a filter cake 115. The well has, as most oil wells have, a partial casing 112 terminated by a casing shoe 113. Well casings are cemented in place and serve to isolate the various pressured formations and to prevent contamination of water-bearing strata with drilling fluid and petroleum.

Problems with differential pressure sticking in such a well normally would occur at the interface between filter cake 115 and drill collar 104.

Figure 2:
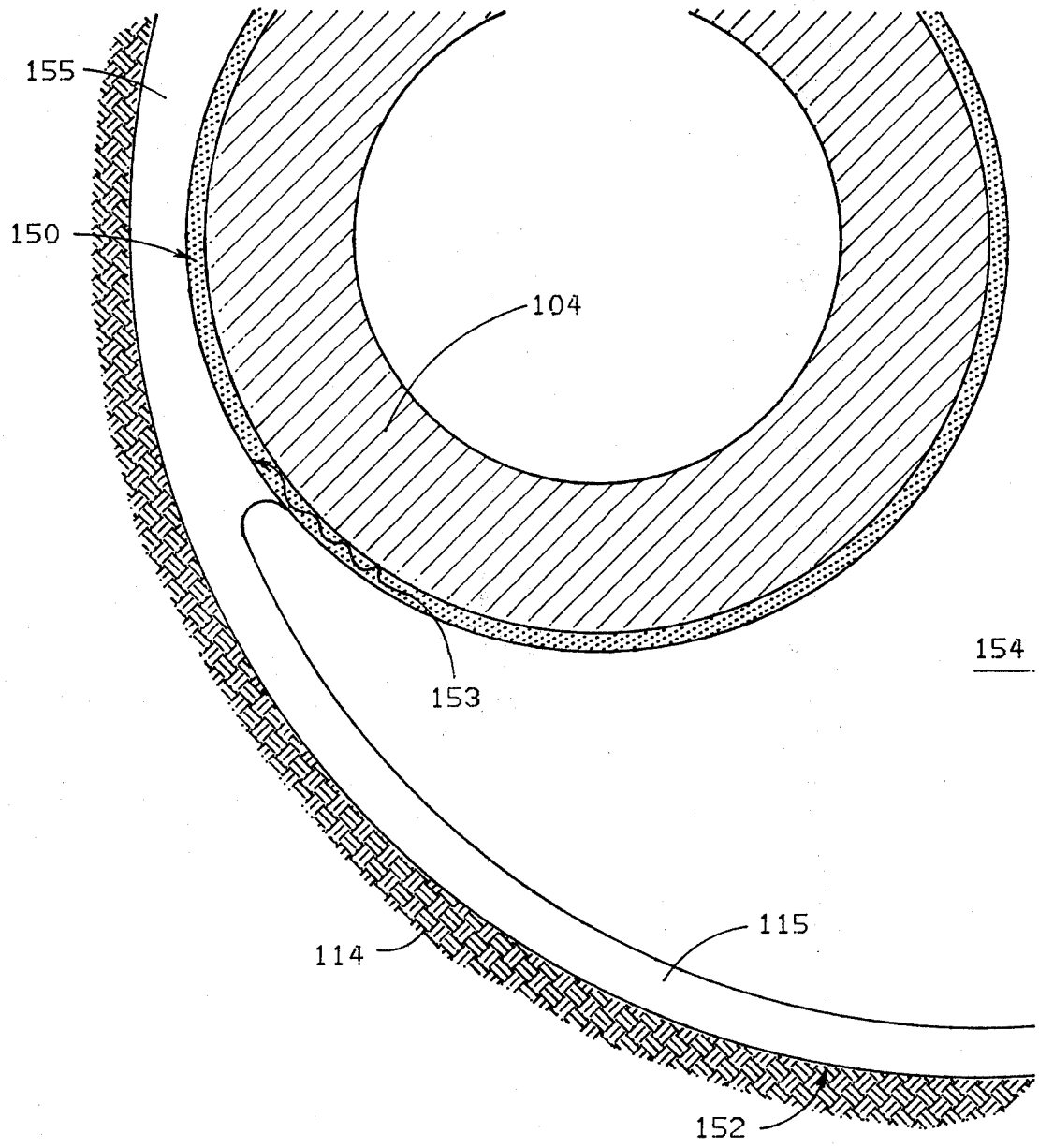
FIG. 2 is a cross-sectional view of a drill collar in a borehole.

FIG. 2 depicts, in horizontal cross-section, a situation in which a drill collar 104 made in accordance with the present invention is in contact with a low pressure formation 114 having a filter cake 115 deposited thereon. The drill collar 104 has the inventive porous coating 150 disposed about it. The drill collar 104, in this example, squeezed in or abraded away a portion of filter cake 115 and formed a thin area 155. Since the hydrostatic pressure of the drilling fluid in wellbore annulus 154 is higher than the pressure in formation 114, a potential differential pressure sticking situation is present.

The wellbore implements of the instant invention, such as the drill collars depicted in FIGS. 1 and 2, or various logging tools, have thereon a porous coating. Although the composition of the coating is not a critical feature of the invention, the most desirable compositions are comprised of those metals which adhere to the steels used in most drilling implements after proper treatment and are corrosion and wear resistant in the borehole environment. The coating may also have dispersed within it a number of abrasive particles. These abrasives are used to prolong the life of the coating and may be materials such as SiC, WC, corundum, etc.

The use of porous ceramic and glass materials which are sufficiently tough to undertake the impactive rigors of rig handling and borehole environment without substantial degradation are certainly within the scope of this invention.

In theory, the coating prevents differential pressure sticking for two reasons. First, the rough outer surface of the coating does not readily provide a seal between the implement and the filter cake. Secondly, the network of small tunnels within coating 150 allows the higher pressure fluid in borehole annulus 154 to flow via a path 153 to the vicinity of highest differential pressure to lower the pressure differential at the interface between the drill collars and the filter cake and enable movement of the drill string.

Figure 3A:
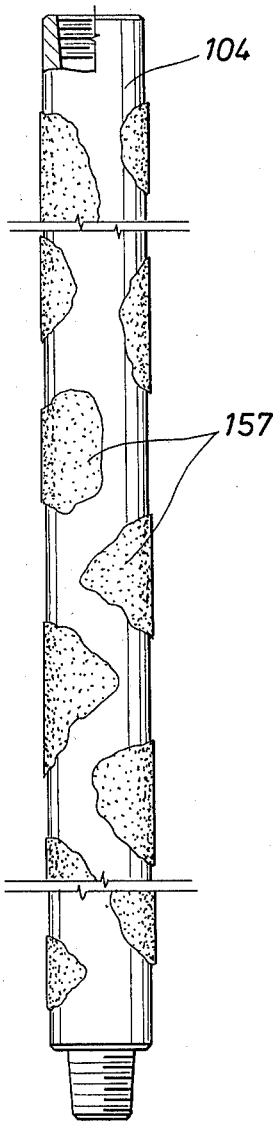
FIG. 3A is a side view of a drill collar having mottled layers of porous material attached thereto.
Figure 3B:
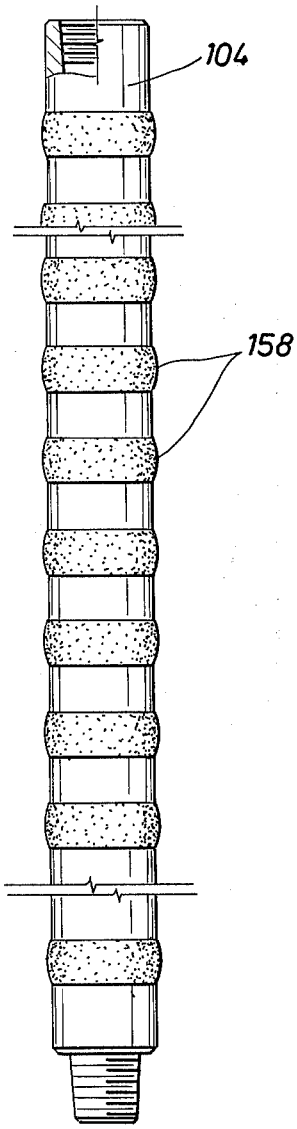
FIG. 3B is a side view of a drill collar having bands of porous material attached thereto.

The coating need not completely cover the outside area of the implement. It must, however, mask a sufficient proportion of the implement's outer surface to prevent differential pressure sticking. As shown in FIG. 3A, the coating may comprise mottled areas 157 in its coverage of an implement such as the depicted drill collar 104. The most desirable configuration is shown in FIG. 3B entails bands of coating 158. The coating need not be uniform in thickness in either event although such is desirable from the viewpoint of lessened solids buildup on the drill collar.

Figure 4:
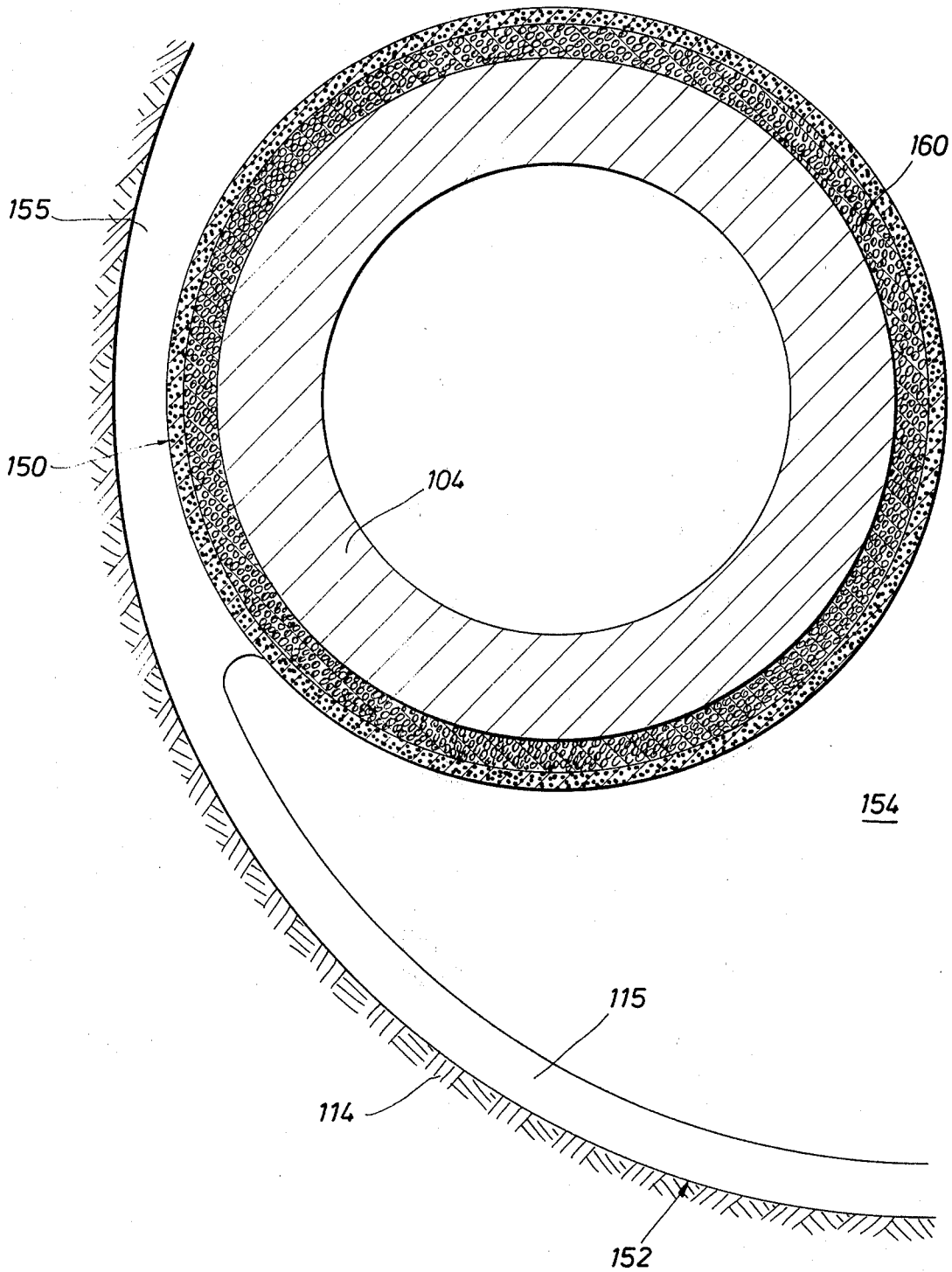
FIG. 4 is a cross-sectional view of a drill collar having multiple layers of porous material on its exterior and situated in a borehole.

Another desirable configuration is shown in FIG. 4 and entails multiple layers of coatings of different permeabilities, e.g., an inner layer 160 or layers produced with large particles and thereby having a higher permeability, covered by an outer layer 150 produced from smaller particles having lower permeability. This allows the liquid to flow quickly through the inner layer to the contact area while the outer layer would be less susceptible to plugging.

Production of the coating may take place by resort to any well-known prior art method. The often corrosive environment presented by drilling fluids somewhat limits the choice of materials which are suitable as coatings for the drill implements. However, application of powdered iron alloys with or without additional abrasive material such as silica or alundum to steel and iron substrates is shown in U.S. Pat. No. 2,350,179 (issued on May 30, 1944 to Marvin). The process taught therein partially presinters the powders to create a preform corresponding in shape to the desired backing. The presintered form is placed on its backing material and both are raised to a temperature suitable for sintering the particles and bonding them to the support. A reducing atmosphere is used in the latter sintering step. The sintered layer is then rolled either while still in the sintering oven or shortly after its exit to enhance the adhesion between the layers.

Another suitable method for producing a porous coating on a drill implement is disclosed in U.S. Pat. No. 3,753,757 (issued on Aug. 31, 1973 to Rodgers et al). This process entails first applying a diluted polyisobutylene polymer to the implement. The polymer forms a tacky base to which metal powders will adhere. An appropriate metal powder of iron, steel, or stainless steel is then applied to the tacky surface preferably by electrostatic spraying. The implement is heated to a first temperature sufficient to volatilize the isobutylene polymer and a second temperature sufficient to bond the powder to itself and the implement.

The optional abrasive powders are mixed with the metal powders at or before the time of application. The sintering temperature of most abrasives is significantly higher than that of any metal or alloy realistically useful on a drill implement. For instance, the sintering temperatures of tungsten carbide is 2650°-2700° F. The usual sintering temperature for AISI C1020 carbon steel is generally about 2000° F. A tungsten carbide particle therefore comes through the powder sintering process largely unaffected.

When ferrous powders are used to coat the implement, treating in superheated steam (1000°-1100° F.) for a short length of time after sintering is desirable. Such treatment causes an increase in the wear and corrosion resistance of the coating by producing a thin layer of black iron oxide on the exterior of the particles.

In any event, once the implements are provided with a porous coating, they are used as any uncoated implement would be. However, if so desired, the porous openings in the outer layer may be impregnated with an oleophilic composition having a viscosity between about that of diesel oil and about that of grease. Greases may be applied by a number of methods. For instance, the greases may be diluted in a volatile hydrocarbon solvent and sprayed on the implement. Once the solvent evaporates, the grease will remain both on the surface of the implement and in the outer pores of the applied coating. The greases obviously may also be applied by rolling or brushing. The ligher hydrocarbons may be sprayed or brushed or the implement may be dipped into the hydrocarbon prior to use.

The added oleophilic composition has dual functions. It primarily serves as a localized spotting agent. However, some lubricity is also present especially when heavier hydrocarbons are applied.

In sum, the instant invention is readily applicable to either new or existing well implements. It uses only well known materials and methods of application and yet solves a heretofore serious problem.

However, it should be understood that the foregoing disclosure and description are only illustrative and explanatory of the invention. Various changes in size, shape, materials of construction, and configuration as well as in the details of the illustrated construction may be made within the scope of the appended claims without departing from the spirit of the invention.

We claim:

1. Apparatus suitable for use in a well comprising a substantially imperforate inner sector having an adherent outer porous coating with porosity sufficient to substantially prevent downhole differential sticking.

2. The apparatus of claim 1 wherein the outer coating is multi-layered.

3. The apparatus of claim 2 wherein the outermost layer is less permeable than at least one inner layer.

4. The apparatus of claim 1 wherein the outer coating is configured in the shape of bands around the apparatus.

5. The apparatus of claim 1 wherein the outer coating is in mottled configuration.

6. The apparatus of claim 1 wherein at least a portion of the outer coating is impregnated with a spotting agent.

7. The apparatus of claim 6 wherein the spotting agent is an oleophilic composition having a viscosity between about that of diesel oil and about that of grease.

8. The apparatus of claim 7 wherein the spotting agent is diesel oil.

9. The apparatus of claim 1, 2, 3, 4, 5, or 6 wherein the outer coating is comprised of an iron alloy.

10. The apparatus of claim 9 wherein the outer coating additionally contains a dispersed abrasive composition.

11. The apparatus of claim 10 wherein the abrasive composition is tungsten carbide.

12. A drill collar having an adherent outer porous coating with sufficient porosity to substantially prevent downhole differential pressure sticking.

13. The apparatus of claim 12 wherein the outer coating is multi-layered.

14. The apparatus of claim 13 wherein the outermost layer is less permeable than at least one inner layer.

15. The drill collar of claim 12 wherein the outer coating is configured in the shape of bands around the apparatus.

16. The drill collar of claim 12 wherein the outer coating is in a mottled configuration.

17. The drill collar of claim 12 wherein at least a portion of the outer coating is impregnated with a spotting agent.

18. The drill collar of claim 17 wherein the spotting agent is an oleophilic composition having a viscosity between about that of diesel oil and about that of grease.

19. The drill collar of claim 18 wherein the spotting agent is diesel oil.

20. The drill collar of claims 12, 13, 14, 15, 16 or 17 wherein the outer coating is comprised of an iron alloy.

21. The drill collar of claim 20 wherein the outer coating additionally contains a dispersed abrasive composition.

22. The drill collar of claim 21 wherein the abrasive composition is tungsten carbide.

23. Apparatus suitable for use in a well comprising a substantially imperforate logging tool having an adherent outer porous coating with sufficient porosity to substantially prevent downhole differential pressure sticking.

24. The apparatus of claim 23 wherein the outer coating is multi-layered.

25. The apparatus of claim 24 wherein the outermost layer is less permeable than at least one inner layer.

26. The apparatus of claim 23 wherein the outer coating is configured in the shape of bands around the apparatus.

27. The apparatus of claim 23 wherein the outer coating is in a mottled configuration.

28. The apparatus of claim 23 wherein at least a portion of the outer coating is impregnated with a spotting agent.

29. The apparatus of claim 28 wherein the spotting agent is an oleophilic composition having a viscosity between about that of diesel oil and about that of grease.

30. The apparatus of claim 29 wherein the spotting agent is diesel oil.

31. The apparatus of claims 23, 24, 25, 26, 27 or 28 wherein the outer coating is comprised of an iron alloy.

32. The apparatus of claim 31 wherein the outer coating additionally contains a dispersed abrasive composition.

33. The apparatus of claim 32 wherein the abrasive composition is tungsten carbide.

* * * * *

UNITED STATES PATENT AND TRADEMARK OFFICE

CERTIFICATE OF CORRECTION

PATENT NO. : 4,427,080

DATED : January 24, 1984

INVENTOR(S) : Ronald P. Steiger

It is certified that error appears in the above—identified patent and that said Letters Patent is hereby corrected as shown below:

Claim 1, Column 5, line 62, "sector" should read --section--; line 64, before the word "sticking", insert --pressure--.

Signed and Sealed this

*Thirtieth* Day of *October 1984*

[SEAL]

*Attest:*

GERALD J. MOSSINGHOFF

*Attesting Officer*

*Commissioner of Patents and Trademarks*